US006256940B1

(12) United States Patent
MacKarvich

(10) Patent No.: US 6,256,940 B1
(45) Date of Patent: Jul. 10, 2001

(54) FOUNDATION WITH SIDE STRUTS FOR MANUFACTURED HOME

(76) Inventor: Charles J. MacKarvich, 3940 Paces Manor Dr., Atlanta, GA (US) 30339

( * ) Notice: Subject to any disclaimer, the term of this patent is extended or adjusted under 35 U.S.C. 154(b) by 0 days.

(21) Appl. No.: 09/457,280

(22) Filed: Dec. 8, 1999

Related U.S. Application Data

(63) Continuation-in-part of application No. 09/123,806, filed on Jul. 27, 1998, which is a continuation-in-part of application No. 08/739,717, filed on Oct. 29, 1996, now Pat. No. 5,850,718, which is a continuation-in-part of application No. 08/644,069, filed on May 9, 1996, now Pat. No. 5,784,844, which is a continuation-in-part of application No. 08/629,834, filed on Apr. 10, 1996, now Pat. No. 5,697,191.

(51) Int. Cl.[7] ..... E02D 27/48
(52) U.S. Cl. ..... 52/126.6; 52/292; 52/DIG. 11; 52/169.9
(58) Field of Search ..... 52/146–149, 155, 52/156, 157, 169.9, 126.6, DIG. 11, 292, 299

(56) References Cited

U.S. PATENT DOCUMENTS

| | | | | |
|---|---|---|---|---|
| 3,750,349 | * | 8/1973 | Deike | 52/DIG. 11 |
| 3,751,866 | * | 8/1973 | Renchen | 52/DIG. 11 |
| 3,914,910 | * | 10/1975 | Struben | 52/DIG. 11 |
| 4,180,952 | * | 1/1980 | Vanderlyn | 52/148 |
| 4,272,933 | * | 6/1981 | Lopes | 52/149 |
| 4,560,131 | * | 12/1985 | Eck | 52/DIG. 11 |
| 4,882,887 | * | 11/1989 | Giles et al. | 52/126.6 |
| 4,923,165 | * | 5/1990 | Cockman | 52/157 X |
| 4,976,077 | * | 12/1990 | Tucker | 52/126.6 |
| 5,014,470 | * | 5/1991 | Lane et al. | 52/DIG. 11 |
| 5,509,237 | * | 4/1996 | Coulter | 52/126.6 |

* cited by examiner

*Primary Examiner*—Richard Chilcot
(74) *Attorney, Agent, or Firm*—Thomas, Kayden, Horstemeyer & Risley

(57) ABSTRACT

Side struts (68) are positioned on ground anchors (40, 42) at intervals along the lower side edges of a manufactured home (10). The side struts spread the "footprint" of support from the ground to the manufactured home, so as to decrease the likelihood of tilting, the manufactured home in response to wind and other lateral forces.

32 Claims, 3 Drawing Sheets

FOUNDATION WITH SIDE STRUTS FOR MANUFACTURED HOME

CROSS REFERENCE

This is a continuation-in-part of U.S. patent application Ser. No. 09/123,806 filed Jul. 27, 1998, which is a continuation-in-part of U.S. Ser. No. 08/739,717 filed Oct. 29, 1996, now U.S. Pat. No. 5,850,718 which is a continuation-in-part of U.S. Ser. No. 08/644,069 filed May 9, 1996, now U.S. Pat. No. 5,784,844 which is a continuation-in-part of U.S. Ser. No. 08/629,834 filed Apr. 10, 1996, now U.S. Pat. No 5,697,191.

FIELD OF THE INVENTION

This invention relates generally to a foundation system for a premanufactured home which is supported above the ground on a plurality of piers which engage two or more horizontal, parallel joists of the home. More particularly, the invention relates to a foundation for such a home that includes struts for supporting the edges of the building which overhang the support joists.

BACKGROUND OF THE INVENTION

Premanufactured buildings (hereinafter "manufactured homes") such as mobile homes, trailers, prefabricated houses and the like are manufactured at a central manufacturing site, and upon completion the structures are moved to a location where they are to be permanently located and occupied. Because the manufactured home is designed to be easily moved from the site where it is manufactured to its permanent location, the structure is not originally built upon a permanent foundation at the manufacturing site. Rather, the structure is constructed upon a pair of parallel, horizontally extending I-beam joists. The joists are displaced inwardly from the opposing side walls of the manufactured home, and temporary wheels are attached to the joists so that the manufactured home can be transported over public highways to its installation site, where the home likely will be mounted on piers, such as concrete blocks, pilings, or stabilizing jacks. It is important that the home be anchored in position on the piers, typically with the use of ground anchors and ties extending from the ground anchors to the framework of the home, so as to avoid the home being shifted off of its piers by strong winds or seismic action. Serious damage to the manufactured home and even human injury can occur if a home is inadvertently shifted laterally off of its piers or tilted over.

Various types of stabilizing devices have been used to stabilize such manufactured homes, to keep the homes from moving in response to wind forces and earth movement. Such devices have included guy wires or straps tying the home to ground fixtures or ground anchors which are either permanently or temporarily inserted into the ground. A traditional approach to providing wind storm protection for manufactured homes consists of an anchor having a shank with one or more helical plates at the bottom of the shank which can be rotated to move the anchor into the ground, and cold rolled steel strapping installed as a diagonal tie between the anchor head and the lower main frame of the manufactured home. Anchors of this type are taught in U.S. Pat. Nos. 5,758,460; 5,697,191; 5,784,844; and 5,850.718.

The vertical support for the manufactured home usually is provided by the piers located under the parallel joists of the main frame of the manufactured home, with the piers being spaced longitudinally along the parallel joists at approximately 8 feet intervals. The piers typically are placed upon a flat planar stabilizer foundation plate having a much larger surface area than the pier itself and which stabilizes the pier at its interaction with the ground surface.

While the foregoing stabilizing systems have been more successful in reliably tying down manufactured homes, these and other prior art systems have not successfully addressed the problem of the manufactured home tending to tilt about the parallel support joists and their piers. The support joists are desirably displaced inwardly from the opposed sides of the manufactured home so as to provide adequate support for the intermediate area of the floors of the stricture. Also, it is desirable to place the supporting joists inwardly of the opposed side edges so that the wheels of the transport device can be placed beneath instead of out to the side of the structure when traveling on the highway. The result is that there is a substantial overhang of the side portions of the manufactured home beyond the parallel support joists, so that a substantial amount of the structure is supported by the joists on a cantilever basis. When a lateral force, such as high wind, engages the windward side of a manufactured home, the home tends to tilt about the leeward joist and its piers, so that the weight of the portion of the home which overhangs the leeward joist and its piers aids in tilting the home.

A solution to the above noted problem can be achieved by the placement of side supports along the opposed side edges of the manufactured home. However, there has been no practical, economical and effective structure available for this type of side support for manufactured homes.

It is to the above noted problem that this invention is directed.

SUMMARY OF THE INVENTION

Briefly described, the present invention provides an improved foundation for manufactured homes which includes side struts located along the opposed side edges of the manufactured home, extending from the ground level to the lower side edges of the home. The struts are mounted on ground anchors and extend upwardly from the ground from the anchors into supporting relationship with the lower side edges of the manufactured home. The arrangement is such that the struts bear either compression or tension when the manufactured home tilts either toward or away from the struts.

The ground anchors are constructed with the usual elongated shank with an auger blade rigidly mounted to the lower portion of the shank for holding the anchor in the ground. A support bracket is attached to the upper end of the shank and protrudes out of the ground. A strut is attached at its lower end to the anchor support bracket and extends upwardly to the lower side edge of the manufactured home and the upper end portion of the strut is pivotally mounted to a holding bracket, with the holding bracket having been rigidly attached to the lower side edge of the manufactured home.

The strut is adjustable in length so that it can be adjusted at the site of erection of the manufactured home to achieve the proper length for applying proper support to the lower side edge of the manufactured home.

Should a lower side edge on the windward side of the manufactured home tilt upwardly away from its side struts and ground anchors, the side struts will experience tension from the tilting manufactured home and transmit the tension to the ground anchor. Thus, the ground anchors also function to hold down the windward side of the manufactured home.

In the meantime the ground anchors and struts on the leeward side of the manufactured home resist the compression applied by the tilting home.

The effect of the foundation with side struts is that the "footprint" of the resistance to tilting of the manufactured home is spread farther than the distance between the support joists and piers on which the manufactured home rests.

In addition to the use of the side struts to avoid tilting of the manufactured home, tension straps can be extended from the upper ends of the side struts and sloped downwardly to the lower portion of the pier which is adjacent each side strut. Further, a foundation plate can be installed beneath the pier and on the ground, with the foundation plate having cleats that extend vertically beneath the foundation platform into the ground, with the cleats functioning to resist horizontal movement of the foundation platform. The diagonal tension strap extending from the upper portion of the side strut is connected directly to the foundation platform, so that the lateral movement of the manufactured home which asserts tension on the diagonal tension strap will be resisted by the cleats of the foundation platform that penetrate the ground beneath the manufactured home. This direct line of force between the upper end of the strut and its support bracket and the foundation platform and its cleats avoids the application of forces directly to the pier, avoiding any tilting or other movement to the pier.

In the meantime, the weight of the manufactured home and its piers is applied to the foundation platform, securely holding the foundation platform against the ground so that its cleats cannot be moved in response to the tension applied by the tension strap which slopes upwardly from the foundation platform.

Also, since the side struts are positioned in a supportive relationship with respect to the side edges of the manufactured home, the weight of the home is applied through the side struts to the ground anchor. The weight moving downwardly through the ground anchor is applied to its auger plates, which in turn apply the weight to the cone of influence extending beneath the auger blades, so that the weight of the building structure is applied beneath the ground surface into the ground by the auger blades.

Another benefit of the side struts is that a second set of tension straps can be connected between the ground anchors and joists of the manufactured home and the weight applied by the side edges of the building structure to the side struts is also applied to the ground anchors and functions to stabilize the lower end of the tension straps.

Thus, it is an object of this invention to provide an improved foundation for a manufactured home which is inexpensive to construct, inspect and maintain, and which provides increased stability to the manufactured home.

Another object of this invention is to provide an improved foundation for a manufactured home, where the footprint for resisting tilting of the home is spread to the side edges of the home.

Another object of this invention is to provide side struts for use with the foundation of a premanufactured home which are adjustable in length and which are connectable between the ground anchors and the lower side edges of the manufactured home, for resisting the tilting of the home.

Another object of this invention is to provide an improved method for stabilizing manufactured homes, particularly for preventing the tilting of the homes in response to lateral forces such as wind.

Other objects, features and advantages of this invention will become apparent upon reading the following specification, when taken in conjunction with the accompanying drawings.

DETAILED DESCRIPTION

Figure 1:
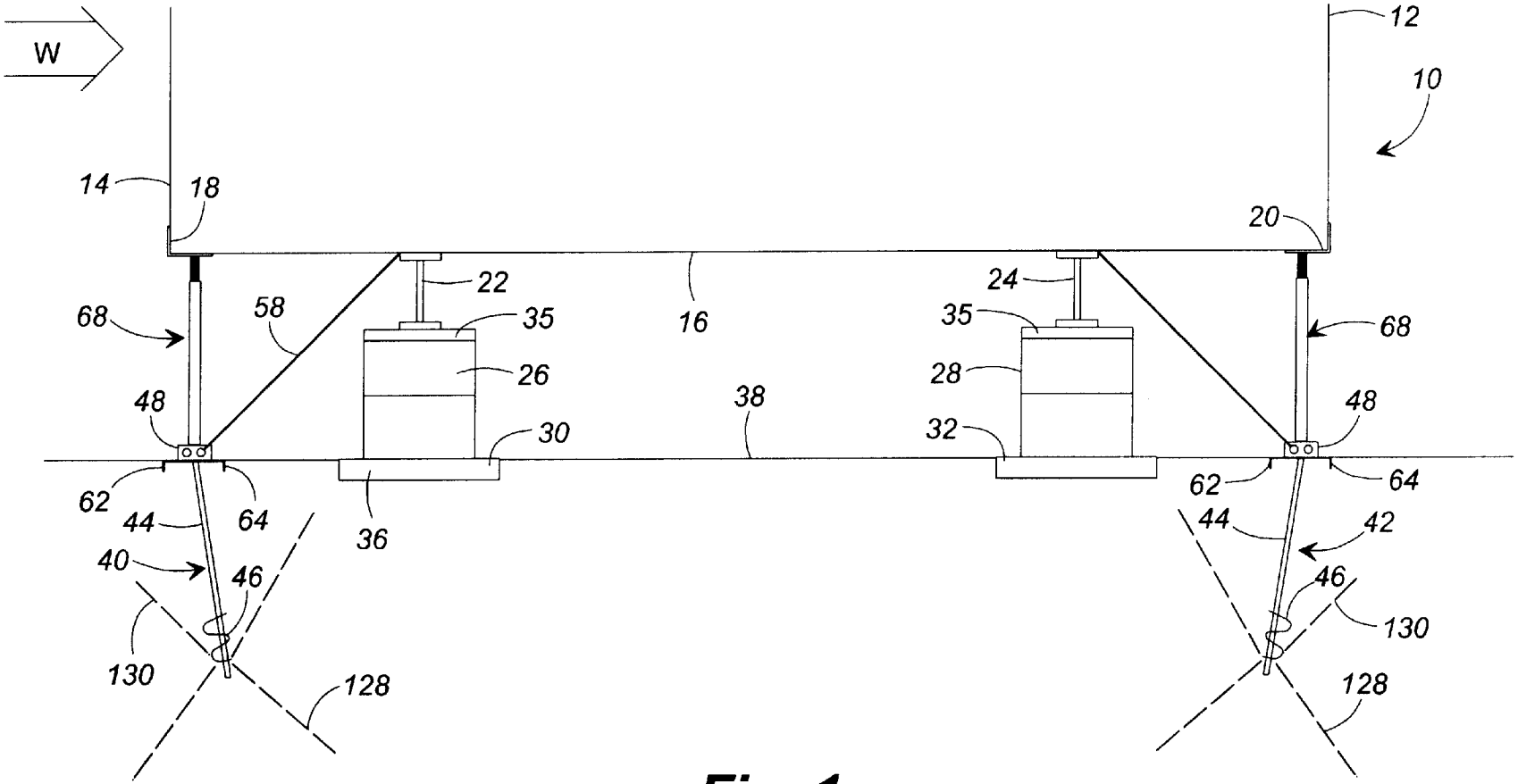
FIG. 1 is an end view of a manufactured home, showing a foundation on which the manufactured home rests.

Referring now in more detail to the drawings in which like numerals indicate like parts throughout the several views, FIG. 1 illustrates a manufactured home 10 which includes opposed vertical sides 12 and 14, a horizontal bottom 16, and lower horizontal side edges 18 and 20 which are formed at the intersection of the opposed sides with the bottom. The parallel, horizontally extending I-beam joists 22 and 24 support and form a part of the manufactured home 10. As previously described, the manufactured home 10 is mounted on the joists 22 and 24 at the centrally located construction site for manufactured homes, and the joists are used for attachment of wheels to the manufactured home when the home is being transported over public highways. When the home arrives at its site of erection, it is to be placed upon a plurality of piers 26 and 28. While only two piers 26 and 28 are shown, it will be understood that there are a plurality of piers 26 extending in alignment with one another beneath the support joist 22, and a similar plurality of piers 28 extending in alignment with one another beneath the joist 24. In this embodiment of the invention, the piers 26 and 28 are mounted on foundation platforms 30 and 32.

Ground anchors such as anchors 40 and 42 of FIG. 1 are embedded in the ground 38 beneath the side edges 18 and 20 of the manufactured home 10. As with the piers 26 and 28, there are a plurality of ground anchors 40 and a plurality of ground anchors 42, with the ground anchors being placed at intervals along and beneath the lower side edges 18 and 20 of the manufactured home. Usually, the ground anchors 40 and 42 will be aligned with a pair of piers 26 and 28, as illustrated in FIG. 1.

The ground anchors 40 and 42 each include a shaft or shank 44 having at its lower end an auger plate 46 and at its upper end a support bracket 48. The support bracket 48 is of conventional design in that it includes a U-shaped plate having its base 50 connected to the upper end of the shank 44, and upwardly extending parallel side walls 52 and 54. Pairs of aligned openings are formed in the side walls for receiving connectors, etc. For example, a bifurcated winch spindle 56 is inserted through one pair of aligned openings of the support bracket 48, and a tension strap 58 is threaded into the slot of the winch spindle and wound about the winch spindle until the proper tension is applied to the tension strap. The noncircular collar of the spindle is inserted into the noncircular opening of the support bracket to prevent further rotation of the winch spindle. The other opening of the support bracket can receive a connector pin, such as pin 60.

Figure 2:
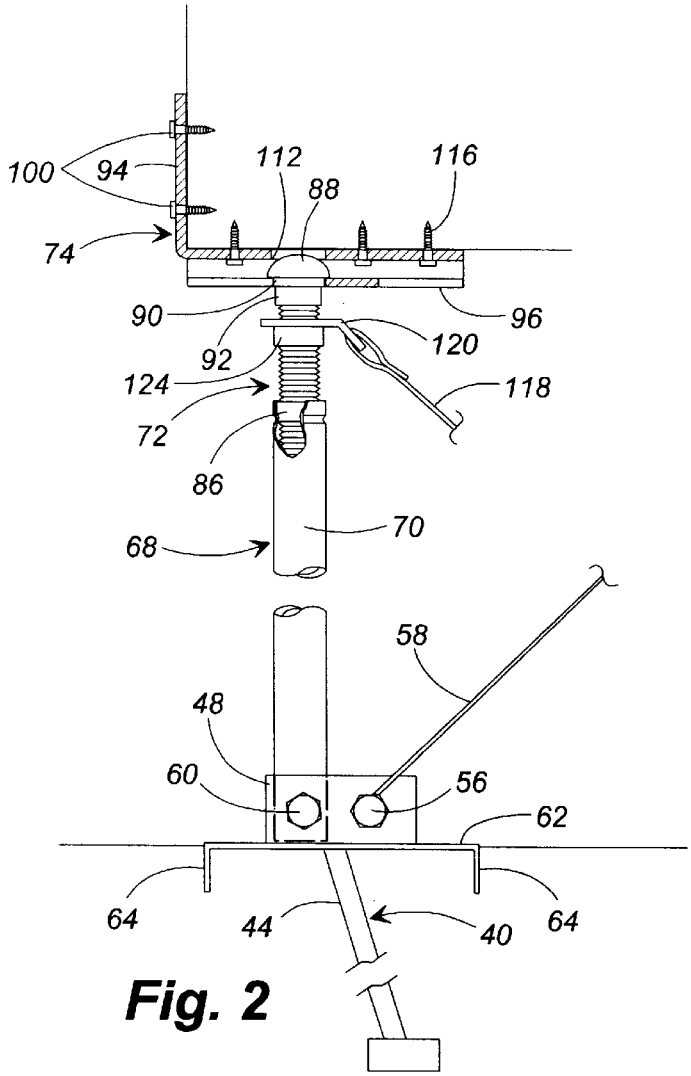
FIG. 2 is an elevational view of a lower side edge portion of a manufactured home, with parts in cross section, showing how a side strut engages between a ground anchor and the lower side edge of the manufactured home.

As illustrated in FIG. 2, a lateral stabilizer 62 is positioned adjacent the intersection of the support bracket 48 and shank 44 of the ground anchor 40. The stabilizer 62 includes ground penetrating cleats 64 which are oriented transverse to the direction of the tension strap 58, and the stabilizer can be rigidly connected to or telescopically mounted to the shank 44, or can be placed between the ground anchor and the adjacent pier, as may be desired. The lateral stabilizer retards lateral movement of the upper end of the ground anchor in response to lateral forces being applied to the ground anchor. A stabilizer of this type is disclosed in my U.S. patent application Ser. No. 09/395,473.

Side strut 68 extends between ground anchor 40 and the lower side edge 18 or 20 of the manufactured home that is located above the ground anchor. Side strut 68 includes support tube 70, threaded bar 72, and support bracket 74. Optionally, a telescopic extension tube 76 can be moved about the lower end of the support tube 70 and a connector pin 78 extended through aligned ones of the openings 80 and 82 for the purpose of adjusting the length of the support tube. Another connector opening 84 is located at the lower end of the telescopic extension tube 76 so that the connector pin 60 can be inserted through one of the aligned pairs of openings of the support bracket 48 and one of the openings 80 or 84.

At the upper end of the support tube 70 is a nut 86 that is swaged into, welded or otherwise affixed to the upper open end of the tube so that it is non-rotatably held in place in the support tube. The external threads of the threaded bar 72 are rotatably received in the threads of the nut 86. In this manner, the threaded bar is telescopically movable into and out of the support tube 70 by means of rotating the threaded bar with respect to the tube.

The upper end of the threaded bar 72 includes a domed cap 88, a cylindrical collar 90, and a square collar 92.

The support bracket 74 can be L-shaped and includes a first, vertical leg 94, and a second, horizontal leg 96. Vertical leg 94 is a flat plate which defines screw receiving openings 98 for wood screws 100 or spikes, or other fastening means for connecting the leg 94 to the vertical side of the manufactured home at the intersection of the vertical side 12 or 14 with the horizontal bottom 16 of the manufactured home. Vertical leg 94 provides horizontal stability to the attachment of the support bracket to the manufactured home; however, the vertical leg can be omitted from the support bracket so as to allow the horizontal leg 96 of the bracket to be positioned farther away from the vertical sidewall of the manufactured home. The horizontal leg 96 is formed into a channel, having a top wall 102, depending side walls 104 and 106, and inwardly turned flanges 108 which form a slot 110 for receiving the domed cap 88 of the threaded bar 72.

The horizontal leg 96 includes a dome opening 112 for locating the domed cap 88 of threaded bar 72 along the length of the slot 110 of the horizontal leg 96. Screw openings 114 are positioned on opposite sides of the dome opening 112, and screws 116 fasten the second leg to the horizontal bottom surface 16 of the manufactured home. Also, the screws 116 prevent inadvertent removal of the domed cap 88 of the threaded bar from the support bracket 74. The annular edge of the dome opening which is smaller than the domed cap 88 presents a circular bearing surface for the domed cap, and the depth of the domed cap 88 is less than the depth of the slot 110 of the support bracket 74, which allows the threaded bar 72 to swivel with respect to the support bracket.

The square collar 92 of the threaded bar 72 which protrudes down below the bracket 74 allows the installer to rotate the threaded bar 72 with a wrench or similar tool after the threaded bar has been inserted into the support bracket. This facilitates the lengthening or shortening of the combined length of the threaded bar 72 and the support tube 70 of the side strut 68.

A tension strap 118 can be attached to the threaded bar 72 by means of the strap connector bracket 120. The bracket has an opening 122 which surrounds the threaded bar 72, and a threaded nut 124 is threaded onto the threaded bar behind the strap connector bracket so as to make sure that the bracket is positioned as high as possible on the threaded bar 72.

When the manufactured home is to be mounted on the foundation, the foundation platforms 30 and 32 are moved into place on the ground. The piers 26 and 28, which usually comprise concrete blocks, are placed on the foundation platforms 30 and 32. The manufactured home 10 is then placed on the piers. Shims 35 typically are wedged between the piers and the I-beam joists 22 so as to level the manufactured home. Ground anchors 40 and 44 typically are driven into the ground after the manufactured home 10 has been placed on its piers. Preferably, the ground anchors are placed in vertical alignment beneath the lower side edges 18 and 20 of the manufactured home, also in lateral alignment with an adjacent pier, usually with the ground anchors being slightly tilted at the convenience of the worker installing the ground anchors. Side struts 68 are each connected between a ground anchor 40 or 42 and the adjacent lower side edge 12 or 14 of the manufactured home 10. The connector pin 60 connects the lower end of the side strut to the support bracket 48 of the ground anchor. The L-shaped support bracket 74 is fastened to the vertical side wall of the manufactured home with screws 100, etc., and the domed cap 88 is slidably inserted in the slot 110 of the horizontal leg of the L-shaped support bracket. Screws 116 are then driven through the horizontal leg and into the horizontal bottom of the manufactured home. This captures the threaded bar 72 in the horizontal leg 96, in the vicinity of the dome opening 112.

Once situated as described, the worker then adjusts the length of the side strut 68 by rotating the threaded bar 72 in the support tube 70, until the desired compression is experienced in the side strut due to the weight of the manufactured home 10 bearing downwardly at its lower side edge against the side strut.

The weight of the manufactured home is then borne in sequence by the side struts and by the ground anchors, particularly by the auger plates 46 of the ground anchors bearing against the dirt beneath the ground anchor, in an inverted cone of influence 128 that extends downwardly from the ground anchors.

Should the manufactured home tilt upwardly away from the side struts, the connection between the manufactured home, side struts and ground anchors cause a restraining force to be applied from the cone of influence 130 that extends upwardly from the auger plates 46 of the ground anchors, so that the side struts tend to hold the manufactured home in place.

Figure 3:
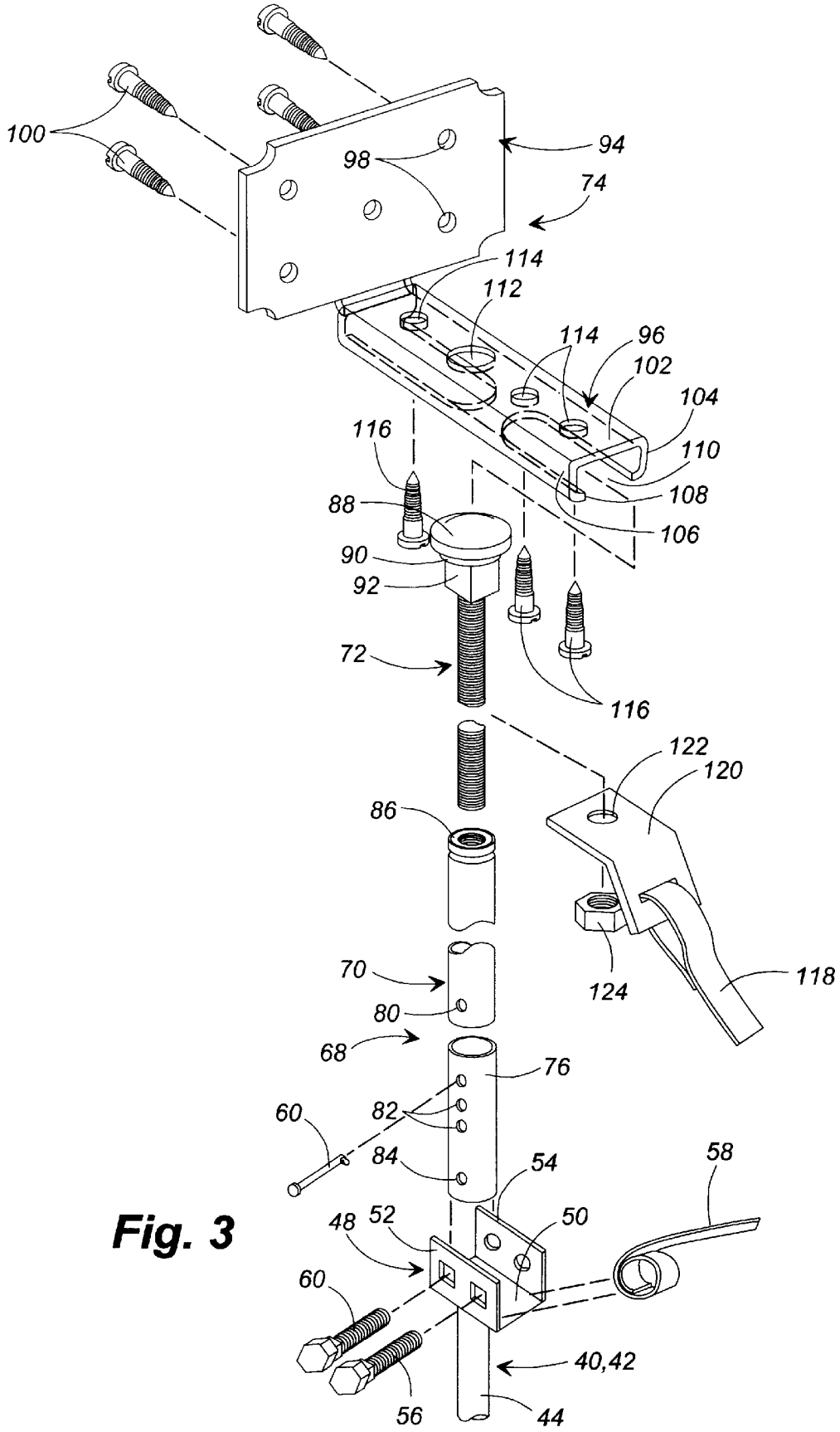
FIG. 3 is an expanded perspective illustration of a side strut, its support bracket and its ground anchor.

In addition to the installation of the side struts, tension straps such as tension strap 58 and tension strap 118 of FIG. 2 can be installed. Tension strap 58 extends from the winch spindle 56 (FIG. 3) and up to the joist 22, with a U-shaped clip (not shown) fastening the tension strap to the remote side of the joist. Tension strap 58 resists lateral movement of the manufactured home as might be induced by a wind force W against the vertical side wall 14 of the manufactured home. Movement of the strap 58 is resisted by the weight applied by the manufactured home downwardly through the side strut 68 to the ground anchor 40. In addition, lateral movement of the ground anchor is resisted by the cleats 64 of the lateral stabilizer 62 (FIG. 2).

Figure 4:
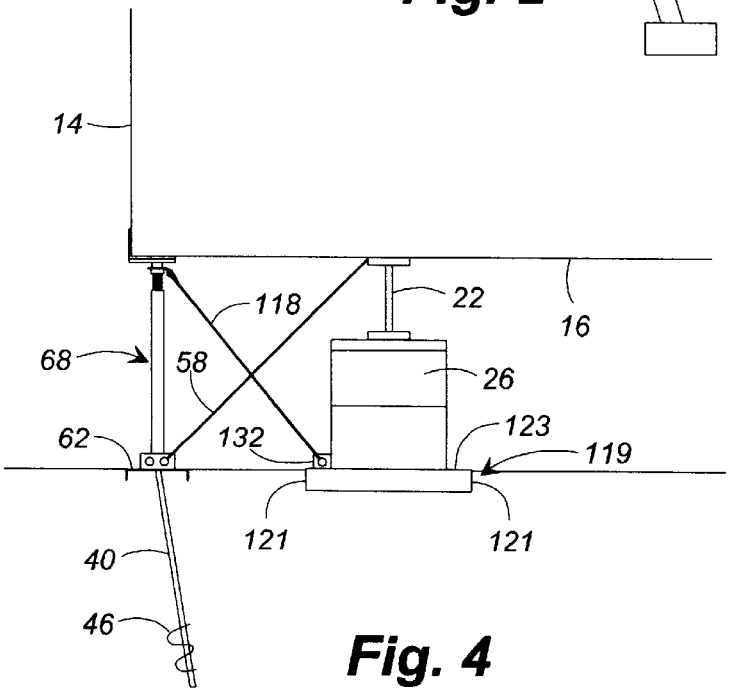
FIG. 4 is an end view, similar to FIG. 1, showing one side of a manufactured home and its foundation, which further includes additional tension straps extending between the anchor head and the adjacent I-beam joists of the manufactured home.

FIG. 4 illustrates the installation of FIG. 1, but includes additional tension strap 118 and cleated foundation platform 119. The tension strap 118 extends between the foundation platforms 119 and the upper ends of side struts 68. As illustrated in FIG. 4, foundation platforms 119, which are described in detail in U.S. patent application Ser. No. 6,058,663 generally comprise a planar top surface 123 and downwardly extending side edges 121 that form cleats that extend downwardly from opposed edges of the top surface 123 and which penetrate into the ground 38. The cleats can be formed on two opposed edges or on all four opposed edges of the rectangular top 123 of the platforms. The cleats retard lateral movement of the foundation platforms 119. Connectors 132 connect the lower end of the tension straps 118 to the foundation platforms 119, and strap connector brackets 120 (FIG. 3) connect the upper ends of the tension straps 118 to the side struts 68. Should a lateral movement be induced in the manufactured home, the tension straps 118 on the leeward side of the home would resist lateral movement of the side struts while the weight of the home would tend to hold the foundation platforms 119 against the ground, and their cleats 121 would resist lateral movement of the foundation platforms, thereby holding the upper end of the side struts, and thus the manufactured home, from lateral movement.

While the term "tension strap" has been used herein, it will be understood that this expression includes other supports such as cables, wires, bars and other structures which are capable of bearing tension forces. Also, the term "ground anchor" has referred to a particular ground anchor structure but this expression applies to other types of ground anchors. Likewise, the term "stabilizer" includes other types of plates, cylinders and objects that retard horizontal movement of ground anchors.

Although preferred embodiments of the invention have been disclosed in detail herein, it will be obvious to those skilled in the art that variations and modifications of the disclosed embodiments can be made without departing from the spirit and scope of the invention as set forth in the following claims.

What is claimed is:

1. A foundation for a manufactured home, with the home having a lower horizontal side edge and at least one rectilinear joist supporting the home and displaced from the edge and resting on a pier, comprising:

a ground anchor having a shank with a lower end for placement in the ground beneath the edge of the home and an upper end for protruding above the ground, and an auger blade mounted to the lower end of said shank for holding the anchor in the ground, a strut for extending directly between said ground anchor and the home, a first connector connecting one end of said strut to said ground anchor with the weight of the home supported by said auger blade, and a second connector for connecting the other end of said strut to the edge of the home, so that said strut extends upwardly from said ground anchor to support the edge of the home from said auger blade of said ground anchor.

2. The foundation according to claim 1, wherein said strut is adjustable in length.

3. The foundation according to claim 1, wherein ground anchor includes a lateral stabilizer positioned adjacent and shaped for resisting lateral movement of said shank through the ground.

4. The foundation according to claim 1, and further including a support bracket mounted to the upper end of said shank for protruding out of the ground, and wherein said first connector is connected to said support bracket.

5. The foundation according to claim 1, and further including a support bracket mounted to the upper end of said shank, a winch mounted in said support bracket, and a tension strap connected at one of its ends to said winch and for connection at its other end to the joist of the home.

6. The foundation according to claim 1, and further including a tension strap connected at one of its ends to said strut and for support at its other end by the pier.

7. The foundation according to claim 1, and further including a tension strap connected at one of its ends to the upper end of said strut and sloped downwardly from said strut for support at its other end by the pier.

8. The foundation according to claim 1, and further including a foundation platform for supporting a pier on which the home is mounted, said foundation platform including a connector, and a tension strap extending between said platform connector and said strut at the upper end of said strut for connecting said strut to said platform.

9. The foundation according to claim 8, wherein said foundation platform includes cleats extending into the ground so that lateral forces applied from said tension strap to said foundation platform are resisted by the cleats.

10. The foundation according to claim 1, wherein said strut includes at least two segments telescopically connected together.

11. The foundation according to claim 1, wherein said strut includes a threaded tubular element and a complementary threaded extender engaging said tubular element which, when rotated with respect to each other, change the length of said strut.

12. The foundation according to claim 1, wherein the edge of the home to which the foundation is to be connected includes intersecting vertical and horizontal surfaces, and wherein said second connector includes a support bracket mountable to the horizontal surface of the home.

13. The foundation according to claim 12, wherein said strut is connected to said support bracket.

14. A foundation for a manufactured home, with the home having intersecting vertical and horizontal surfaces forming a lower horizontal side edge and at least one rectilinear joist supporting the home and displaced from the edge and resting on a pier, comprising:

a ground anchor having a shank with a lower end for placement in the ground beneath the edge of the home and an upper end for protruding above the ground, and an auger blade mounted to the lower end of said shank for holding the anchor in the ground, a strut for extending between said ground anchor and the home, a first connector connecting one end of said strut to said ground anchor, a second connector including a support bracket for connecting the other end of said strut to the horizontal surface of the home, so that said strut extends upwardly from said ground anchor to support the edge of the home from said ground anchor, wherein said second connector and said strut are constructed so that said strut can be swiveled with respect to said second connector.

15. A foundation for a manufactured home, with the home mounted on a pair of horizontally extending parallel joists and the joists resting on piers, and the home having opposed side edges overhanging the joists, comprising:

a plurality of ground anchors embedded in the ground at intervals from one another beneath opposed edges of the home, and a strut mounted directly on each ground anchor and extending upwardly from each ground anchor for engaging the edge of the home positioned over said ground anchors and adapted to apply weight of the home directly to said ground anchor, so that upon tilting of the home in response to external forces the struts and ground anchors support the weight of the home and resist the tilting of the home at the edges of the home.

16. The foundation according to claim 15, and further including first connectors connecting said struts to said ground anchors and second connectors for connecting said struts to the home, whereby the struts can resist both compression and tension forces in response to the tilting of the home.

17. The foundation according to claim 15, and further including tension straps each connected at one of their ends to one of said struts and for support at its second end by a pier.

18. The foundation according to claim 15, and further including tension straps each connected at one of its ends to and anchor and for connection at its other end to a joist of the home.

19. The foundation according to claim 15, and further including a foundation platform for positioning beneath each pier, and tension straps each connected at one of its ends to the upper end of a strut and connected at its other end to a foundation platform.

20. The foundation according to claim 15, wherein said struts are adjustable in length.

21. The foundation according to claim 15, wherein said ground anchors each include a shank and an auger connected to said shank, and a lateral stabilizer positioned adjacent and shaped for resisting lateral movement of said shank through the ground.

22. The foundation according to claim 15, wherein said foundation includes mounting brackets for attaching said struts to said home.

23. The foundation according to claim 15, wherein the edges of the home to which the foundation is to be attached includes intersecting vertical and horizontal surfaces, and wherein said foundation includes L-shaped mounting brackets for attaching said struts to the edges of the home, each said L-shaped bracket including a vertical leg for attachment to the vertical surface of the home and a horizontal leg for attachment to the horizontal surface of the home, said struts being attached to said horizontal legs.

24. A foundation for a manufactured home, with the home mounted on a pair of horizontally extending parallel joists and the joists resting on piers, and the home having intersecting vertical and horizontal surfaces forming opposed side edges overhanging the joists, comprising:

a plurality of ground anchors embedded in the ground at intervals from one another beneath opposed edges of the home, a strut mounted on each ground anchor and extending upwardly from each ground anchor for supporting the edge of the home positioned over said ground anchors, L-shaped mounting brackets for attaching said struts to the edges of the home, each said L-shaped mounting bracket including a vertical leg for attachment to the vertical surface of the home and a horizontal leg for attachment to the horizontal surface of the home, said struts being attached to said horizontal legs, wherein said struts are each pivotally connected to said horizontal legs of said L-shaped brackets, so that upon tilting of the home in response to external forces the struts and ground anchors resist the tilting of the home at the edges of the home.

25. A method of supporting a manufactured home mounted on a pair of horizontal parallel joists displaced from the opposed edges of the home, comprising:

placing the joists of the home on piers, placing ground anchors in the ground beneath the opposed edges of the home, connecting struts directly between the ground anchors and the edges of the home, and upon tilting of the home toward the ground anchors bearing the weight of the home with the ground anchors.

26. The method according to claim 25, and further including the step of connecting tension straps extending between the upper ends of the struts and the piers at a positions on the piers adjacent the ground.

27. The method according to claim 25, and further including the step of connecting tension straps extending between the lower ends of the struts and the joists of the home.

28. The method according to claim 25, and further including the step of supporting the edges of the home with the struts and ground anchors in response to tilting the home.

29. The method according to claim 25, and further including the step of in response to the tilting of the home, supporting one edge of the home with the struts and anchors in compression and supporting the opposite edge of the home with the struts and anchors in tension.

30. The method according to claim 25, wherein the step of placing ground anchors in the ground comprises placing anchors having shanks with auger blades affixed to said shanks in the ground, and wherein the step of bearing the weight of the home with the ground anchors comprises bearing the weight of the home with the auger blades of the ground anchor.

31. The method according to claim 25, and further including the step of adjusting the lengths of the struts to apply support from the ground anchor to the manufactured home.

32. The method according to claim 30, and further including the step of placing horizontal stabilizers in the ground adjacent the shanks of the anchors, and resisting lateral movement of said shanks through the ground with the horizontal stabilizers.

* * * * *